US006157322A

United States Patent [19]

Anderson

[11] Patent Number: 6,157,322

[45] **Date of Patent: *Dec. 5, 2000**

[54] AUTOMATED RAILROAD CROSSING WARNING SYSTEM

[76] Inventor: Merrill J. Anderson, 6421 S. 107th St., Omaha, Nebr. 68127

[ * ] Notice: This patent is subject to a terminal disclaimer.

[21] Appl. No.: 08/150,360

[22] Filed: Nov. 9, 1993

[51] Int. Cl.[7] ..... G08G 1/16

[52] U.S. Cl. ..... 340/903; 340/904; 340/907; 246/293; 246/294

[58] Field of Search ..... 340/902–904, 340/907; 364/436, 438; 246/125, 292–295

[56] References Cited

U.S. PATENT DOCUMENTS

| | | | |
|---|---|---|---|
| 3,758,775 | 9/1973 | Hopkins | 246/125 |
| 3,838,271 | 9/1974 | Ackard et al. | 246/125 |
| 3,867,719 | 2/1975 | Perrin | 340/902 |
| 4,090,685 | 5/1978 | Pappas | 246/125 |
| 4,108,405 | 8/1978 | Gibson | 246/125 |
| 4,942,395 | 7/1990 | Ferarri et al. | 340/907 |

*Primary Examiner*—Jeffery A. Hofsass
*Assistant Examiner*—Anh V. La
*Attorney, Agent, or Firm*—Sanford E. Warren, Jr.; Russell Holloway; Gardere & Wynne, LLP

[57] ABSTRACT

An automated railroad crossing warning system includes a housing mounted at the intersection of a railroad track and a roadway with directional horns oriented in opposite directions to direct horn blasts along the roadway. A light is mounted on the housing for viewing by a railroad engineer. A control unit detects the presence of a train approaching the intersection and transmits a signal to the horns to activate the horns. A horn detector transmits a signal to the control unit upon activation of the horns at a predetermined decibel level. The control unit then activates the light such that the railroad engineer can visually determine that the horns at the intersection are being activated. The control unit includes an electronic circuit which causes the horns to produce blasts in a predetermined sequence which matches the conventional signal produced by a train engine upon approaching such a crossing.

4 Claims, 6 Drawing Sheets

AUTOMATED RAILROAD CROSSING WARNING SYSTEM

TECHNICAL FIELD

The present invention relates to railroad crossing warning systems, and more particularly to an improved warning system which provides directional audible horns located to direct sound along the road, transverse to the railroad tracks while omitting the need for horn blasts from the locomotive.

BACKGROUND OF THE INVENTION

Grade crossings, where automobile traffic crosses railroad tracks, have been a notorious site for collisions. Various types of warning systems to warn road traffic of the approach of a train, rely on two major warning sources: (1) an audible signal from a locomotive horn, and (2) at least a visual indicator of the presence of the railroad crossing.

While the visual indicator at the railroad crossing varies from a pair of "cross-bucks" to fully automated crossing gates with lights and bells, the second part of the equation continues to rely on the timely occurrence of horn blasts from the locomotive. Since the driver of the automobile must have sufficient time to stop at the crossing in response to a warning signal, the horn blast from the locomotive must occur at a sufficient distance from the automobile driver. In addition, to produce a sound sufficiently loud to be heard by the automobile driver, while the locomotive is still approaching the intersection, the horn blast must be activated at a very high decibel level.

Obviously, the main problem associated with horn blasts on a locomotive is the disturbance to residents of an urban area located adjacent to the crossing. A related, but less common problem, occurs when a train is backing over a crossing, wherein the horn is located on the opposite end of the train.

SUMMARY OF THE INVENTION

It is therefore a general object of the present invention to provide an improved railroad crossing warning system.

Another object of the present invention is to provide a railroad crossing warning system which does not require horn blasts from a locomotive approaching the intersection.

Yet another object is to provide a railroad crossing warning system with directional control of an audible horn at the intersection.

Still another object of the present invention is to provide a railroad crossing warning system which simulates the sound and pattern of an approaching locomotive to a predetermined area along the road.

Another object is to provide a railroad crossing warning system which indicates the operation of the horns to the locomotive engineer.

These and other objects will be apparent to those skilled in the art.

The automated railroad crossing warning system of the present invention includes a housing mounted at the intersection with directional horns oriented in opposite directions to direct horn blasts along the roadway. A light is mounted on the housing for viewing by a railroad engineer. A control unit detects the presence of a train approaching the intersection and transmits a signal to the horns to activate the horns. A horn detector transmits a signal to the control unit upon activation of the horns at a predetermined decibel level. The control unit then activates the light such that the railroad engineer can visually determine that the horns at the intersection are being activated. The control unit includes an electronic circuit which causes the horns to produce blasts in a predetermined sequence which matches the conventional signal produced by a train engine upon approaching such a crossing.

DESCRIPTION OF THE PREFERRED EMBODIMENT

Figure 1:
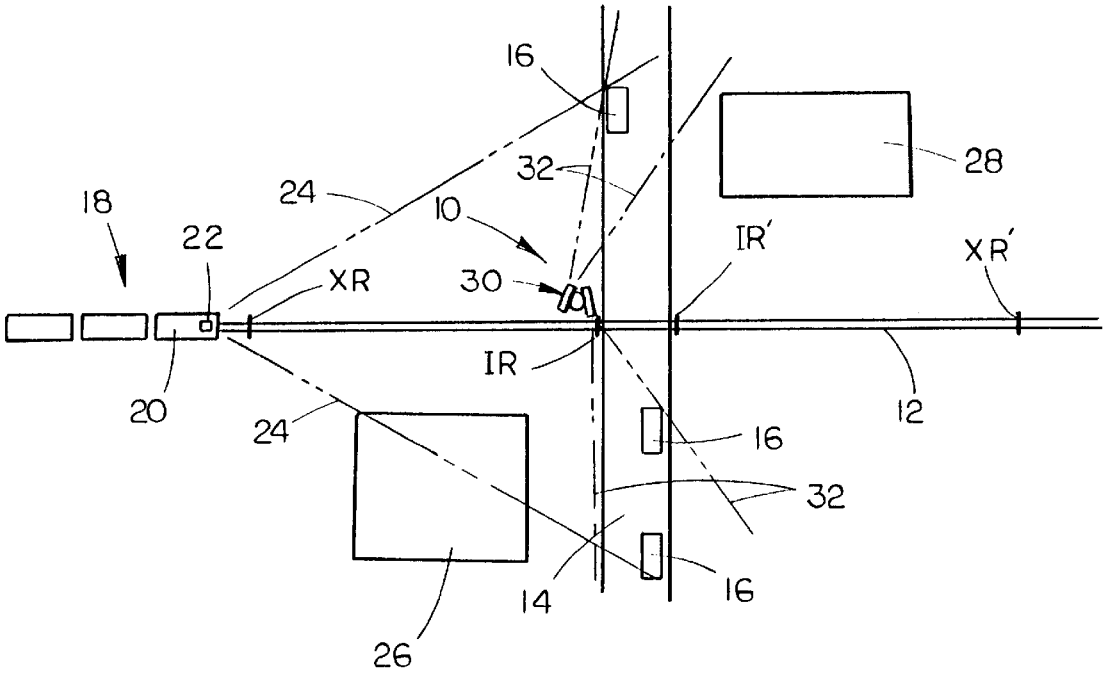
FIG. 1 is a site plan of a conventional grade crossing showing the warning system of the present invention.

Referring now to the drawings, in which similar or corresponding parts are identified with the same reference numeral, and more particularly to FIG. 1, a railroad grade crossing is designated generally at 10 with the railroad tracks designated at 12 and a road 14 oriented generally transverse to tracks 12 with automobiles 16 thereon. A train 18 on tracks 12 includes a locomotive 20 with a horn 22 mounted thereon.

As shown in FIG. 1, the locomotive horn 22 has a generally triangular area bounded by lines 24 over which the loudest portion of the horn sound will travel. In order to alert automobiles 16 with sufficient time to stop prior to crossing tracks 12, the locomotive horn 22 must be sounded at a predetermined distance from crossing 10 such that lines 24 extend a sufficient distance outwardly from track 12 on road 14. FIG. 1 clearly shows that the sound area 24 will encompass buildings 26 and 28 on both sides of track 12 in addition to large expanses of area bounding track 12.

The warning system of the present invention includes a pair of control and alert units designated generally at 30 located at crossing 10 with a directional sound area designated generally by lines 32. It can be seen that sound areas 32 are directed transversely to the tracks 12 so as to generally follow the road 14, outwardly from track 12. Thus, the sound areas 32 may be more narrowly confined so as to avoid directly covering surrounding buildings, such as buildings 26 and 28.

Figure 3:
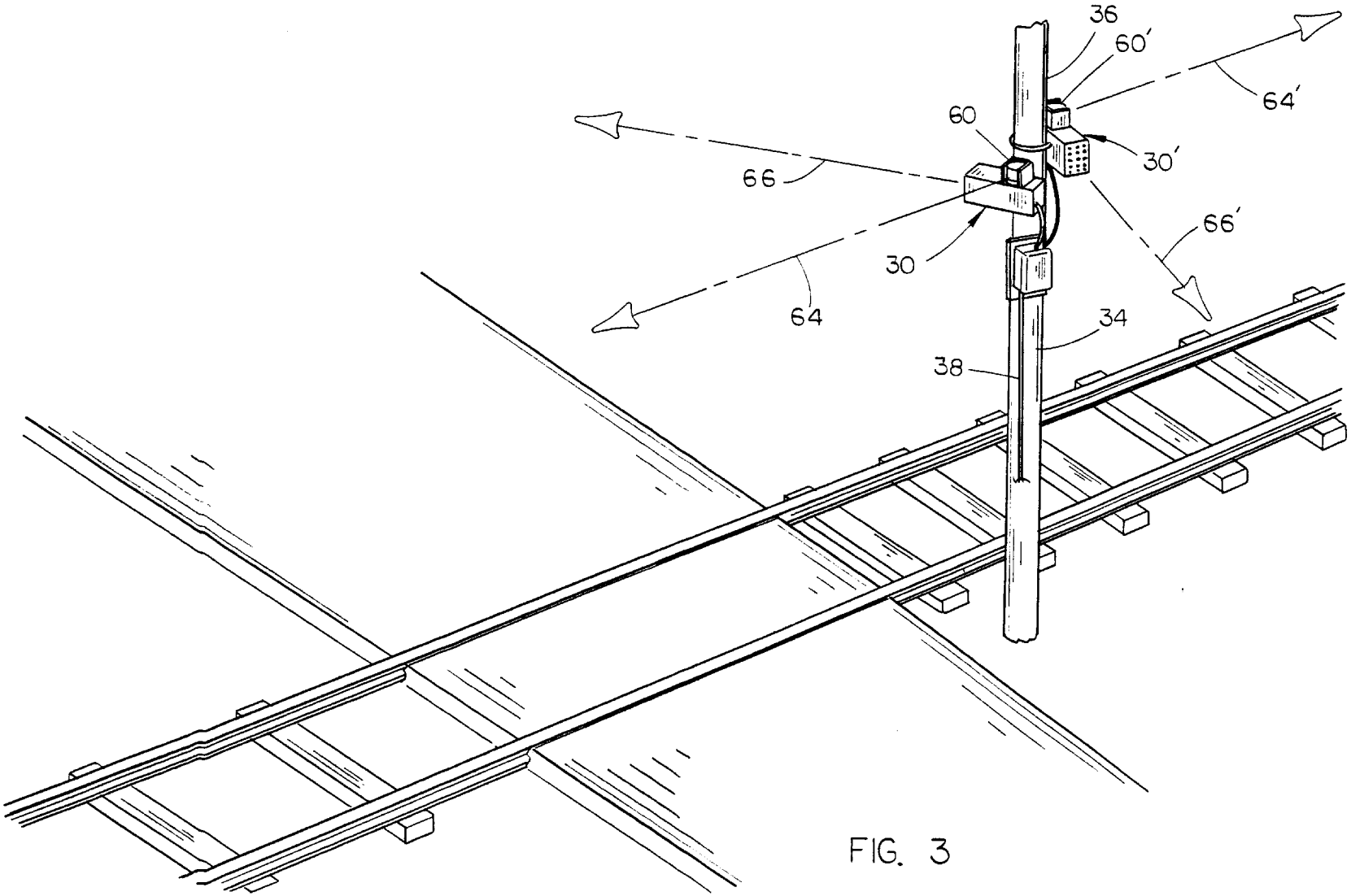
FIG. 3 is a pictorial view of two control and alert units mounted on a pole at a crossing site.

Referring now to FIG. 3, a pair of control and alert units 30 and 30' are shown mounted on an upright pole 34 which is preferably located immediately adjacent a crossing 10 (not shown). Pole 34 includes a power line 36 which supplies electrical power to units 30. A signal line 38 provides the appropriate triggering signals, as described in more detail hereinbelow to units 30.

Each control and alert unit 30 includes an enclosed housing 40 having a forward end 42, a rearward end 44, top and bottom 46 and 48 and side panels 50 and 52. Forward end 42 includes perforations 54 to permit sound from a horn 56 to project outwardly from housing 40. Horn 56 is electrically connected to a control box 58 within housing 40. A horn detector 57 is mounted in housing 40 to detect the sound of horn 56, as described below.

A strobe light 60 is mounted on the top 46 of housing 40 and has a blinder plate 62 extending around three sides thereof such that light is directed generally in a single direction outwardly in a direction indicated by arrows 64. In a unit which utilizes a single housing for sound in opposing directions, the transverse wall of the blinder plate 62 would be removed, such that strobe light 60 could be viewed in both directions. Sound from horn 56 is generally directed along arrow 66, in a direction transverse to that of arrow 64, as described hereinbelow.

As mentioned above, power line 36 is connected to control box 58 and supplies power to the control circuitry therein. Signal line 38 also enters housing 40 through side panel 52 and is connected to control box 58.

Units 30 and corresponding unit 30' are mounted on pole 34 such that strobe lights 60 and 60' have their light direction as indicated by arrows 64 and 64' in opposite directions. Similarly, the sound directions, indicated by arrows 66 and 66' are oriented to direct the sound in opposite directions. In this way, a light 60 or 60' may be viewed by the locomotive engineer approaching the crossing 10 from either direction.

Figure 2:
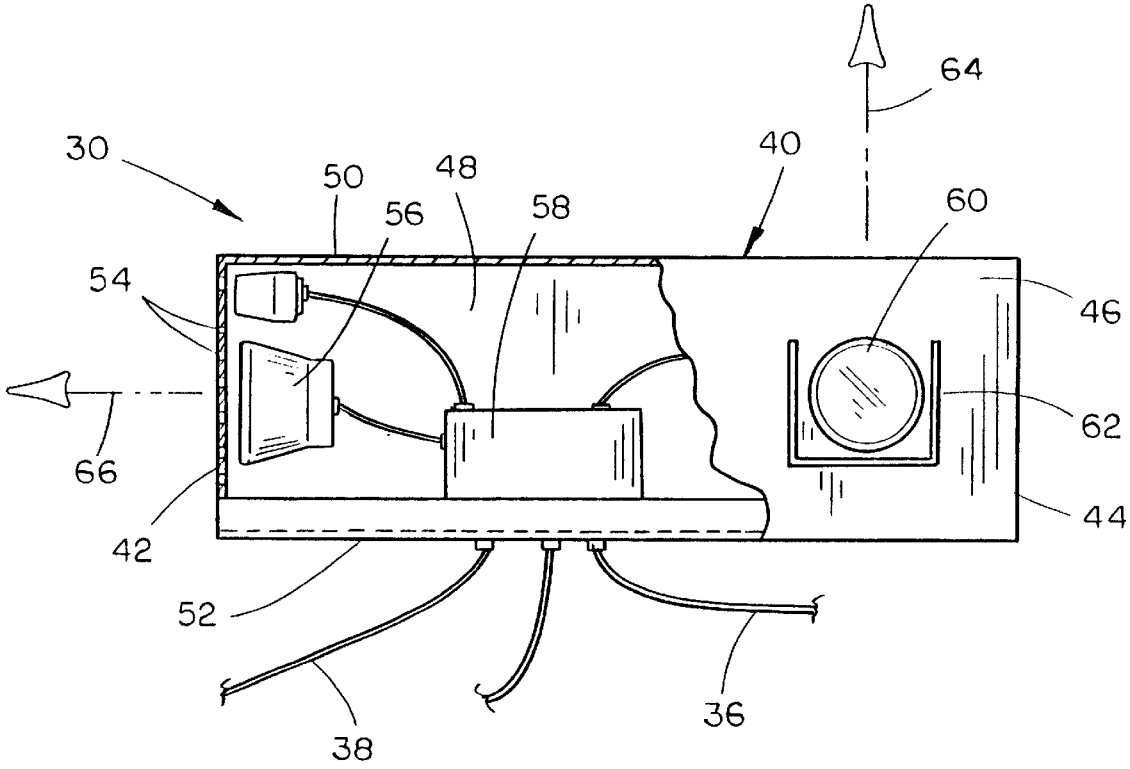
FIG. 2 is a partially broken away top plan view of one control and alert unit of the present invention.
Figure 4:
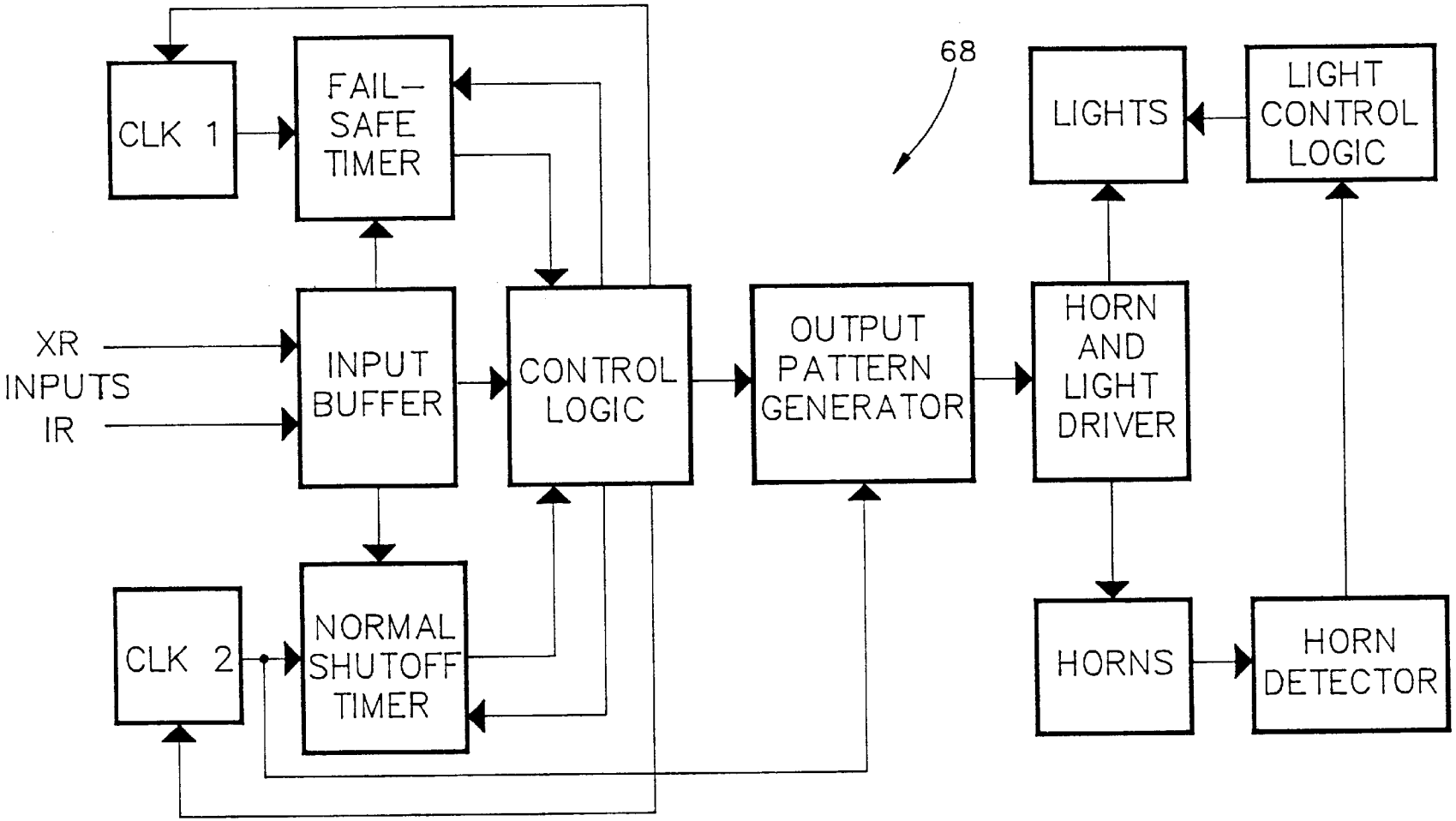
FIG. 4 is block diagram of the circuitry of the control unit.
Figure 5A:
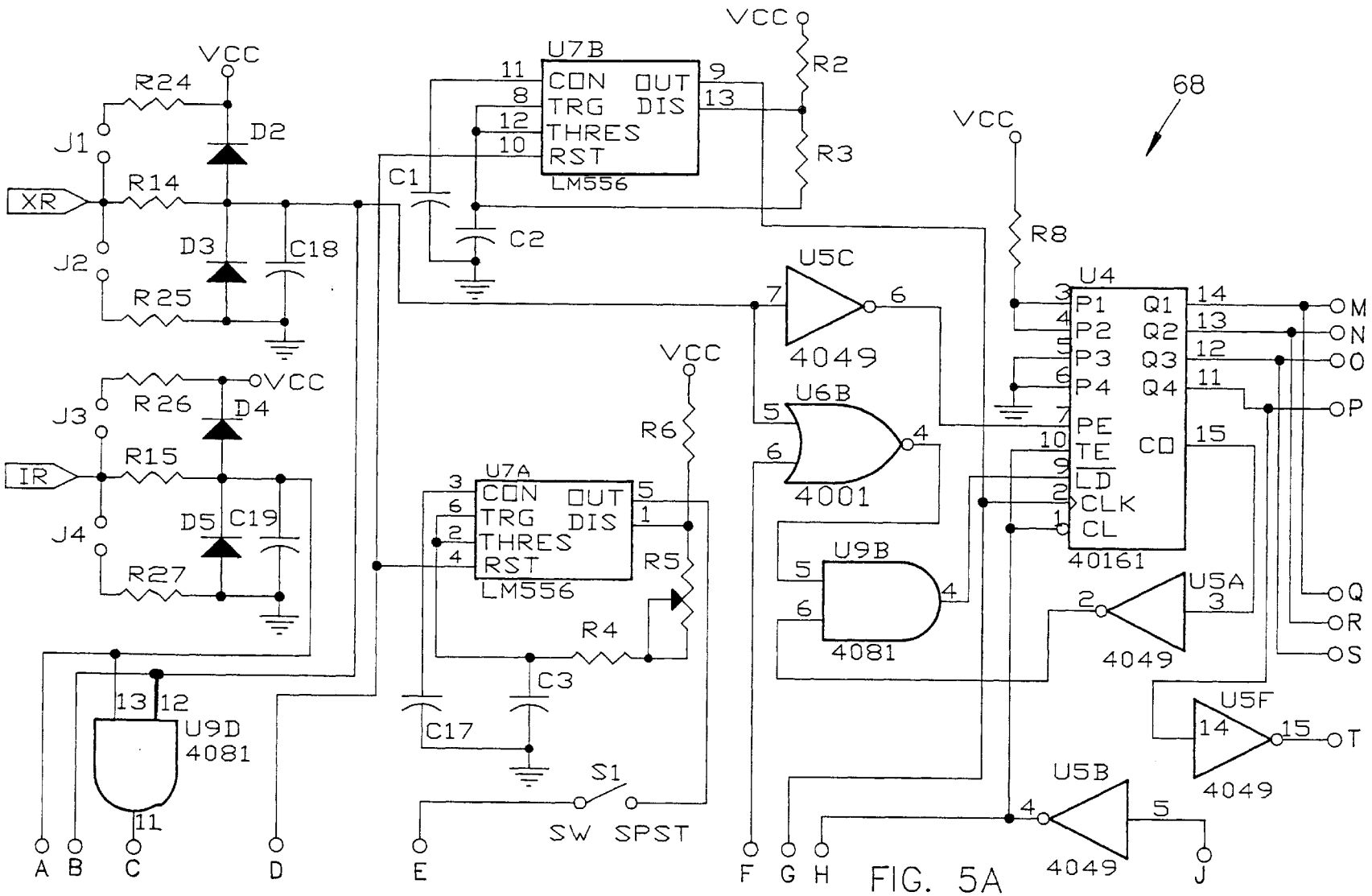
FIG. 5A is an electrical schematic diagram of a portion of the circuitry of the control unit.
Figure 5B:
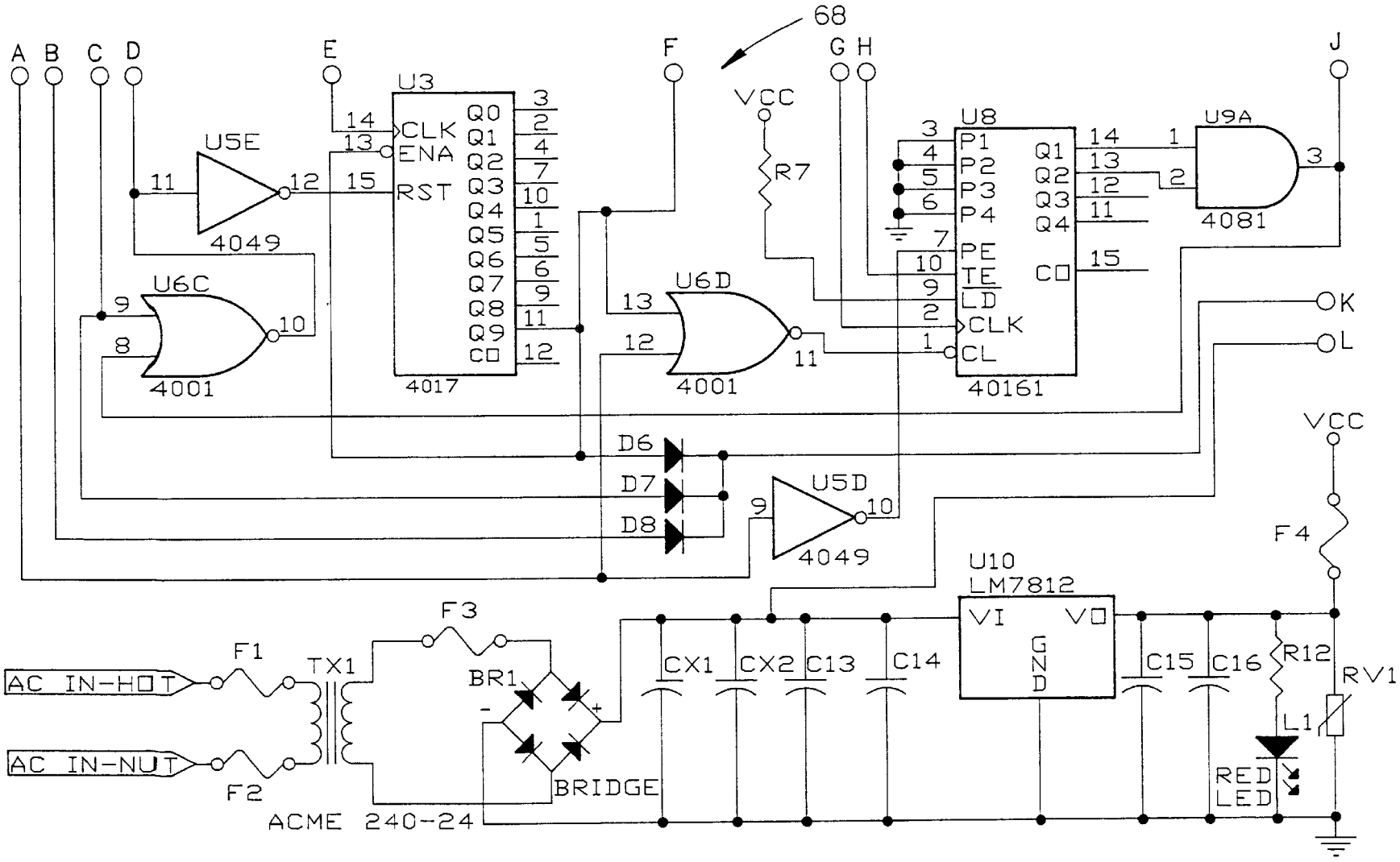
FIG. 5B is an electrical schematic diagram of a portion of the circuitry of the control unit.
Figure 5C:
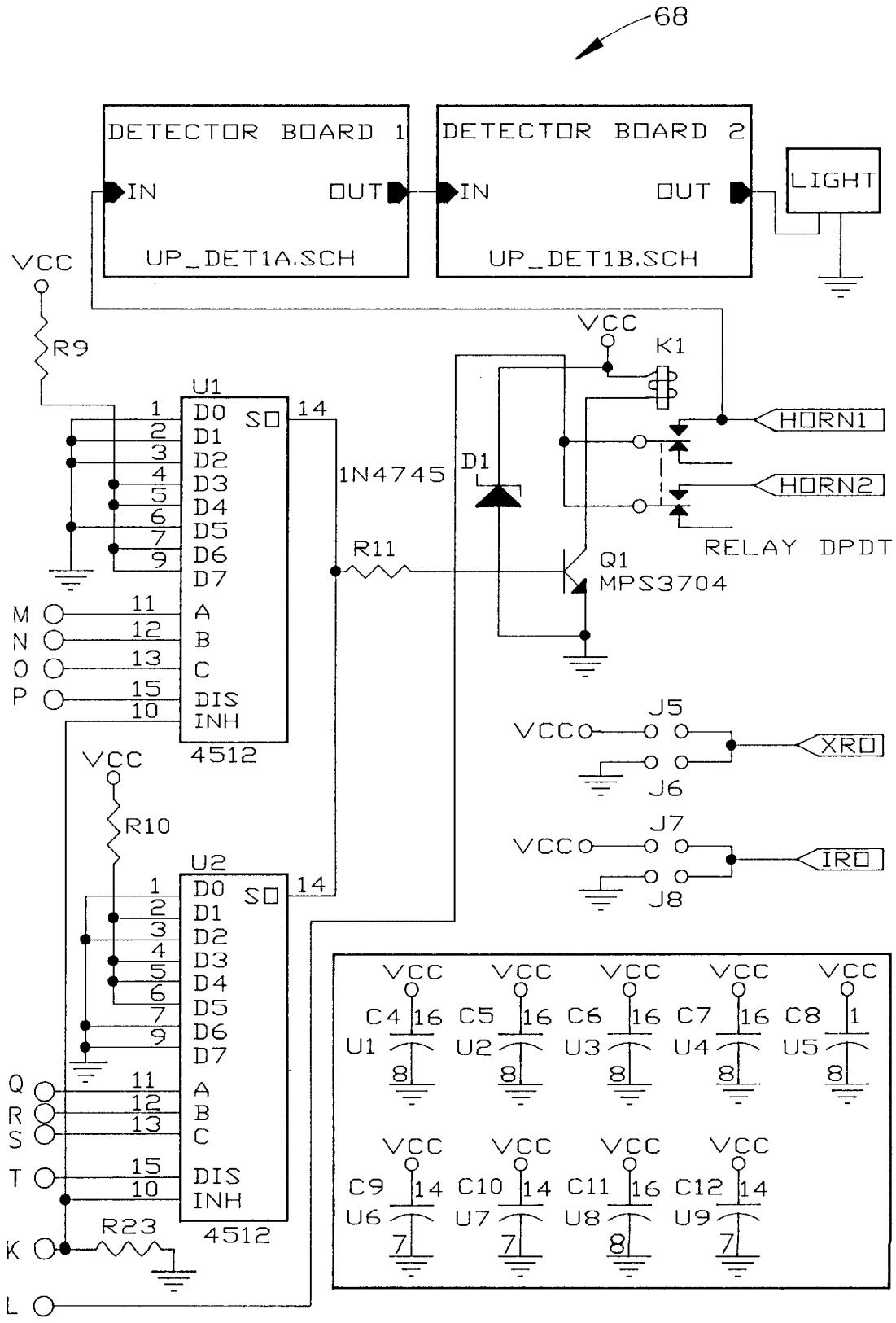
FIG. 5C is an electrical schematic diagram of a portion of the circuitry of the control unit.

Referring now to FIG. 4, the block diagram shown describes the control circuitry within control box 58 (shown in FIG. 2). FIG. 5 is an electrical schematic showing the control circuit 68 of the present invention.

There are two signal inputs to the control circuit 68, shown in FIG. 4, which are activated by a locomotive. A crossing relay signature XR becomes active when the locomotive crosses into a block defined by relays XR and XR' shown in FIG. 1. Conventionally, crossing relays XR and XR' are located approximately one-quarter mile before the crossing 10. The second signal input is an island relay signal IR which is activated when the locomotive crosses into the block bounded by relays IR and IR', also shown in FIG. 1. Preferably, relays IR and IR' are located immediately adjacent the crossing 10. As shown in FIG. 2, input signals XR and IR are transmitted over signal line 38 to control box 58 and control circuit 68 therein.

As shown in FIG. 4, signals from XR and IR inputs are first buffered. As shown in FIG. 5, the XR input buffers include R14, R24, D2, D3, and C18, while IR input buffers include R15, R25, D4, D5, and C19. The input buffers form a time delay circuit to avoid false triggering caused by voltage spikes on the inputs, and limit the input current.

After the input buffer, the XR and IR signals are passed to the control logic circuit for further processing. As shown in FIG. 5, the control logic circuit includes U5C, U5D, U5E, U6B, U6C, U6D, U9B, U9D, D6, D7, D8 and R23. When the control logic circuit receives an "ACTIVE" signal from the XR input and an "IDLE" signal from the IR input, this combination indicates that a locomotive is approaching the crossing and that the warning horns should be sounded. The control logic then switches to an active mode which passes a signal to the output pattern generator. The output pattern generator produces a signal which will cause the horn to sound in a pattern which imitates that utilized by locomotives to indicate the approach of a train to a crossing. More specifically, this signal includes two long blasts, a short blast and a long blast. As shown in FIG. 5, the output pattern generator includes CLOCK 2, U4, U1, U2, U5A, U5F, R8, R9 and R10.

A signal from the output pattern generator is passed to the horn and light driver, which operate the horn to produce the warning sound, as well as a strobe light to indicate the proper operation of the horn. The horn and light driver includes R11, Q1, D1, and K1, as shown in FIG. 5.

As noted above, when activated, the horn and light driver will pass a signal to the horns, according to the pattern received from the pattern generator, and will pass a signal to the lights, to activate both the horn and lights. The light is utilized to provide an indicator to the locomotive engineer that the horns are blowing at the crossing. If the lights fail to activate upon the approach of a locomotive, the engineer will see that the horns are not being activated and can then blow the locomotive horn to provide adequate warning at the crossing. As shown in FIG. 4, a horn detector will detect the operation of the horn and pass a signal to the light control logic. The light control logic determines whether the sound from the horn is of a predetermined magnitude. If the magnitude is sufficient to surpass a predetermined threshold, the lights are permitted to be activated by the horn and light driver. If the horn is either off or not of sufficient magnitude to meet a predetermined threshold, the light control logic will not permit the lights to operate.

Referring again to FIGS. 1 and 4, the movement of locomotive 20 into crossing 10 will activate the IR input while the XR input is still active. This combination indicates that the locomotive has reached crossing 10 and that the warning horns may cease. The control logic then enters a "WAIT" mode wherein the horns will continue to blow in the same pattern for approximately five seconds, and then shut off until a change in the inputs occurs.

As the train proceeds through the crossing, and leaves the IR block, the IR input signal changes to "IDLE" or "INACTIVE" while the XR signal remains active. This combination indicates that the train has cleared the crossing. At this point, the circuit enters the "check back" mode and waits approximately five seconds to determine whether there is a change to the XR input. If the XR input becomes inactive, this indicates that there are no more trains approaching, at which time the circuit enters a "STAND-BY" mode. On the other hand, if the XR input remains active after the five second interval, this indicates that another locomotive is approaching (such as at multiple track crossings) and the circuit will again enter the "ACTIVE" mode.

The fail safe timer, shown in FIG. 4, is utilized in situations where the XR input signal is falsely activated and remains activated due to a malfunction. Without the fail safe timer, the circuit 68 would remain in the active mode, and thereby continue to sound the horns. The fail safe timer is adjustable from approximately two to four minutes and would cause the circuit to enter a "fail safe" mode wherein the horns are silenced. The circuit would remain in this mode until the circuit re-enters the "STAND-BY" mode by returning the XR and IR inputs to the idle or inactive condition. The fail safe timer includes CLOCK 1, U3 and S1, as shown in FIG. 5. The normal shut off timer includes CLOCK 2, U8, U9A, U5B and R7.

The control logic also includes a "WAIT" mode which is enabled when an active signal is received from the IR input while the XR input remains inactive. The wait mode maintains the horn and lights in the deactivated condition.

Whereas the invention has been shown and described in connection with the preferred embodiment thereof, it will be understood that many modifications, substitutions and additions may be made which are within the intended broad scope of the appended claims. There has therefore been shown and described an improved railroad crossing warning system which accomplishes at least all of the above stated objects.

I claim:

1. A warning system for the intersection of a railroad track with a roadway, comprising:

audible alarm means mounted to a housing and located at the intersection of the railroad track and roadway;

said audible alarm means including means for producing a directional audible signal in opposing directions, said alarm means mounted within a housing which restricts disbursement of audible sound to a sound area having boundaries oriented generally long the roadway and generally transverse to said railroad track;

a control means connected to said alarm means, for detecting the presence of a vehicle at predetermined locations on said railroad track, and for activating said alarm means only in response to the detection of a vehicle approaching the intersection; and visual display means for visually indicating the activation of said alarm means, connected to said control means and responsive to signals from said control means;

said control means including means for detecting the operation of said alarm means including means for detecting decibel level of the audible signal and means for transmitting a signal to said visual display means only upon detection of an audible signal above a predetermined decibel level.

2. The warning system of claim 1, wherein said visual display means includes means for masking said visual display from viewing in directions transverse to the railroad track.

3. The warning system of claim 1, wherein said audible signal is the sound of a train horn.

4. The warning system of claim 3, wherein said control means includes means for producing a predetermined sequence of train horn blasts upon activation of the alarm means.

* * * * *